US010610899B2

(12) United States Patent
Earp

(10) Patent No.: US 10,610,899 B2
(45) Date of Patent: Apr. 7, 2020

(54) OPERATION-SIDE CONTAINMENT STRUCTURE FOR AUTOMATED CLEANING OF A PROCESS VESSEL

(71) Applicant: Danny Earp, La Porte, TX (US)

(72) Inventor: Danny Earp, La Porte, TX (US)

( * ) Notice: Subject to any disclaimer, the term of this patent is extended or adjusted under 35 U.S.C. 154(b) by 2 days.

(21) Appl. No.: 15/081,566

(22) Filed: Mar. 25, 2016

(65) Prior Publication Data

US 2016/0279676 A1 Sep. 29, 2016

Related U.S. Application Data

(60) Provisional application No. 62/139,515, filed on Mar. 27, 2015.

(51) Int. Cl.

| | |
|---|---|
| ***B08B 3/02*** | (2006.01) |
| ***B65D 33/02*** | (2006.01) |
| ***B65D 33/16*** | (2006.01) |
| ***F28G 9/00*** | (2006.01) |
| ***B08B 17/02*** | (2006.01) |

(52) U.S. Cl.

CPC ..... *B08B 3/02* (2013.01); *B08B 17/025* (2013.01); *B65D 33/02* (2013.01); *B65D 33/16* (2013.01); *F28G 9/00* (2013.01)

(58) Field of Classification Search

None

See application file for complete search history.

(56) References Cited

U.S. PATENT DOCUMENTS

| | | | |
|---|---|---|---|
| 5,379,810 | A | 1/1995 | Marino |
| 5,967,200 | A | 10/1999 | Hall |
| 7,753,090 | B2 | 7/2010 | Earp |
| 2011/0056519 | A1 | 3/2011 | Card et al. |

FOREIGN PATENT DOCUMENTS

| | | | |
|---|---|---|---|
| CA | 2639516 | | 3/2010 |
| CN | 103436142 | A * | 12/2013 |
| WO | WO 99/65797 | | 12/1999 |

OTHER PUBLICATIONS

English abstract for CN-103436142, retrieved Jun. 1, 2018 (Year: 2018).*

U.S. Appl. No. 14/220,615, filed Mar. 20, 2014, Earp.

* cited by examiner

*Primary Examiner* — Eric W Golightly

(74) *Attorney, Agent, or Firm* — BakerHostetler

(57) ABSTRACT

A containment structure includes a skeleton support structure and a partial enclosure formed of sheets to house an automated system for cleaning process equipment, such as heat exchangers. The partial enclosure includes a front sheet, a pair of opposing side sheets, a rear sheet, a top sheet, and a floor sheet. Each one of the front sheet and side sheets is supported by the skeleton structure. The side sheets have a rear height that is less than a front height of the side sheets and the rear sheet has a height that is less than a height of the front sheet.

21 Claims, 4 Drawing Sheets

10

OPERATION-SIDE CONTAINMENT STRUCTURE FOR AUTOMATED CLEANING OF A PROCESS VESSEL

CROSS-REFERENCE

This application claims the benefit under 35 U.S.C § 119(e) of Provisional U.S. Patent Application No. 62/139,515 filed on Mar. 27, 2015, and entitled "OPERATION-SIDE CONTAINMENT STRUCTURE FOR AUTOMATED CLEANING OF A PROCESS VESSEL," the content of which is incorporated by reference herein in its entirety.

TECHNICAL FIELD

This disclosure relates generally to a system and method for automated spray cleaning operations, and more particularly, to a system and method for handling effluent during a hydroblasting operation of a vessel.

BACKGROUND

In the petrochemical industry, process equipment and vessels can require cleaning to remove deposits or buildup on their interior surfaces. Cleaning vessels of deposits often requires shutting down the associated production line and at least partial disassembly of the vessel being cleaned.

Often a pressurized and heated fluid stream is injected into the vessel to dissolve or dislodge the deposits from the solid interior surfaces of the vessel. For example, spraying a pressurized liquid into a vessel at pressures above 10,000 psi is referred to as hydroblasting. In a typical hydroblasting operation, a heat exchanger or other process vessel is open at both ends. An operator operates a lance at the proximal end to apply high pressure liquid to the interior of the heat exchanger such that the fluid effluent, usually still under some pressure, emerges from the opposite, distal end.

U.S. Pat. No. 7,753,090, which was invented by the present inventor, discloses a device for containing the outflow of waste material from the distal end vessel during by hydroblasting or similar pressurized fluid jet process. U.S. patent application Ser. No. 14/220,615, which was invented by the present inventor, discloses a trough-shaped container for the operator end of a vessel cleaned by spray cleaning.

SUMMARY

In a conventional, manual hydroblasting (or like) spray cleaning of process vessels (that is, where a person manipulates a lance or spray head), misdirected or reflected spray may be directed in virtually any direction, including rearward. Accordingly, the trough disclosed of U.S. patent application Ser. No. 14/220,615, is configured for general, operator end collection of containment of spray cleaning effluent.

Automated spray equipment, however, has a particular problem that has up to this point been unappreciated. In this regard, automated spray equipment in some circumstances directs misdirected or reflected spray in an approximate plane that is perpendicular to the spray direction and perpendicular to the longitudinal axis of the process vessel. Accordingly, the inventor has developed a containment structure that contains perpendicularly directed spray. To the rear of a hood (that is, opposite to the process vessel) is an open pen or low-walled structure that enables personnel to view the automated spray process.

A containment structure for use in automated spray cleaning of a process vessel includes: a skeleton structure and a chemically resistant sheet assembly that includes a front sheet, a pair of opposing side sheets, a rear sheet, a top sheet, and a floor sheet. Each one of the front sheet and side sheets is supported by the skeleton structure.

The front sheet has an opening or is adapted for forming an opening therein for mating to an open end of a process vessel end. A front edge of a first one of the side sheets is joined to a first side edge of the front sheet, and a front edge of a second one of the side sheets is joined to a second side edge of the front sheet. The top edge of the first side sheet is joined to a first side edge of the top sheet, and the top edge of the second side sheet is joined to a second side edge of the top sheet. A front edge of the top sheet is joined to a top edge of the front sheet. A first edge of the rear sheet is joined to a rear edge of the first one of the side sheets, and a second edge of the rear sheet is joined to a rear edge of the second one of the side sheets. A front edge of the floor sheet is joined to a bottom edge of the front sheet, a first side edge of the floor sheet is joined to a bottom edge of the first one of the side sheets, a second side edge of the floor sheet is joined to the bottom edge of the second one of the side sheets, and a rear edge of the floor sheet is joined to the bottom edge of the rear sheet.

The side sheet has a rear height that is less than a front height of the side sheet and the rear sheet has a height that is less than a height of the front sheet such that the sheet assembly is adapted for forming a hood over an end of the process vessel and the sheet assembly is partially open at its rear end. The containment structure is adapted for housing automated spray cleaning equipment.

According to another aspect, a containment structure for use in automated spray cleaning of a process vessel includes a chemically resistant sheet assembly that includes a front sheet, a pair of opposing side sheets, a rear sheet, a top sheet, and a floor sheet. Each one of the front sheet and side sheets is adapted for being supported by a skeleton structure.

The front sheet has an opening or is adapted for forming an opening therein for mating to an open end of a process vessel end. A front edge of a first one of the side sheets is adapted to be joined to a first side edge of the front sheet, and a front edge of a second one of the side sheets is adapted to be joined to a second side edge of the front sheet. The top edge of the first side sheet is adapted to be joined to a first side edge of the top sheet, the top edge of the second side sheet is adapted to be joined to a second side edge of the top sheet.

A front edge of the top sheet is adapted to be joined to a top edge of the front sheet. A first edge of the rear sheet is adapted to be joined to a rear edge of the first sheet, and a second edge of the rear sheet is adapted to be joined to a rear edge of the second sheet. A front edge of the floor sheet is adapted to be joined to a bottom edge of the front sheet, a first side edge of the floor sheet is adapted to be joined to a bottom edge of the first side sheet, a second side edge of the floor sheet is adapted to be joined to the bottom edge of the second side sheet, and a rear edge of the floor sheet is adapted to be joined to the bottom edge of the rear sheet.

The side sheet has a rear height that is less than a front height of the side sheet and the rear sheet has a height that is less than a height of the front sheet such that the sheet assembly is adapted for forming a hood over the process vessel end and the sheet assembly is partially open at its rear end. The container structure is adapted for housing automated spray cleaning equipment.

Referring to either of the aspects above, at least the front sheet and the side sheets may include loops through which structural members of the skeleton structure are inserted, such that the front sheet and side sheets are hung from the skeleton structure and the skeleton structure is not exposed to spray liquid of the cleaning operation. The top sheet may include loops through which structural members of the skeleton structure are inserted, such that the top sheet is hung from the skeleton structure.

The containment structure is intended for use with hydroblasting, as defined above, where the spray cleaning is performed by an XY indexer or other automated mover of the hydroblasting spray.

Preferably, at least one of the sheets rest on an outboard side of the skeleton structure and each one of the side sheets is L-shaped. Each one of the edges may be joined to the corresponding edge by a hook-and-loop fastener, or the edges is permanently joined, such as by stitching or heat welding. The sheets preferably are formed of a reinforced nylon material having anti-static properties, and/or an anti-static material. The assembly may be disposable and when used with a hazardous substance is intended for a single use. The skeleton structure may be modular such that the structure is capable of being disassembled and later reassembled at another site. The front sheet or side sheet may form an opening on site to locate and size an opening to correspond to the process vessel end for personnel access.

A method of operating the containment structure described above includes setting up the modular skeleton, installing the sheet assembly on the skeleton structure, cutting an opening in the front sheet and installing the front sheet around the end of the pressure vessel, and operating automated spray equipment to clean the process vessel using the personnel access opening for ingress and egress from the containment structure. The method may further include the steps of, after the cleaning process, removing the sheets from the skeleton structure and disposing of the sheets, and disassembling the skeleton structure and preparing it for another use.

BRIEF DESCRIPTION OF THE DRAWINGS

The figures schematically illustrate various views of an embodiment of the containment structure.

DETAILED DESCRIPTION

Figure 1:
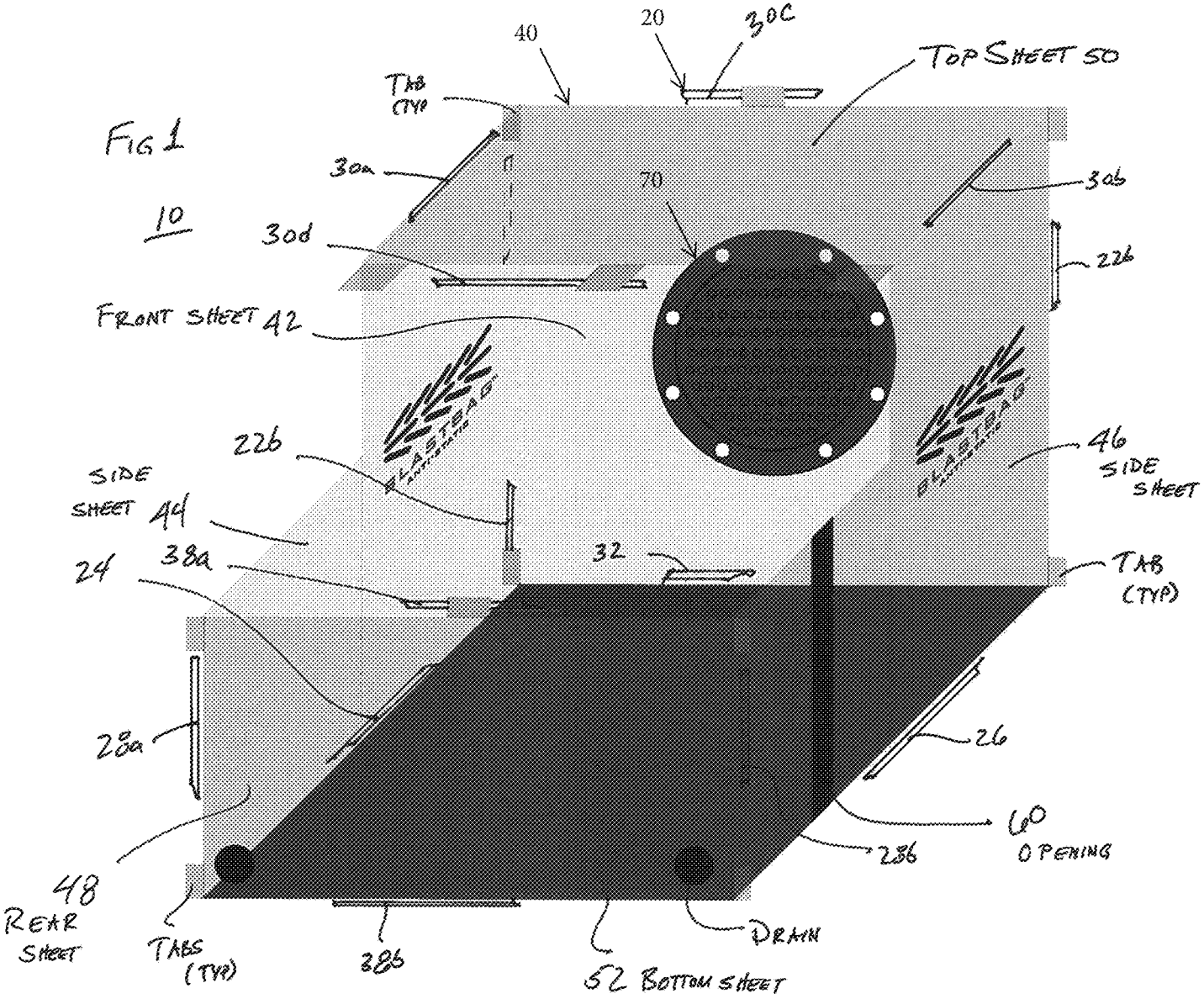
FIG. 1 is a perspective schematic view of the assembly engaged with an end of the process vessel.
Figure 2:
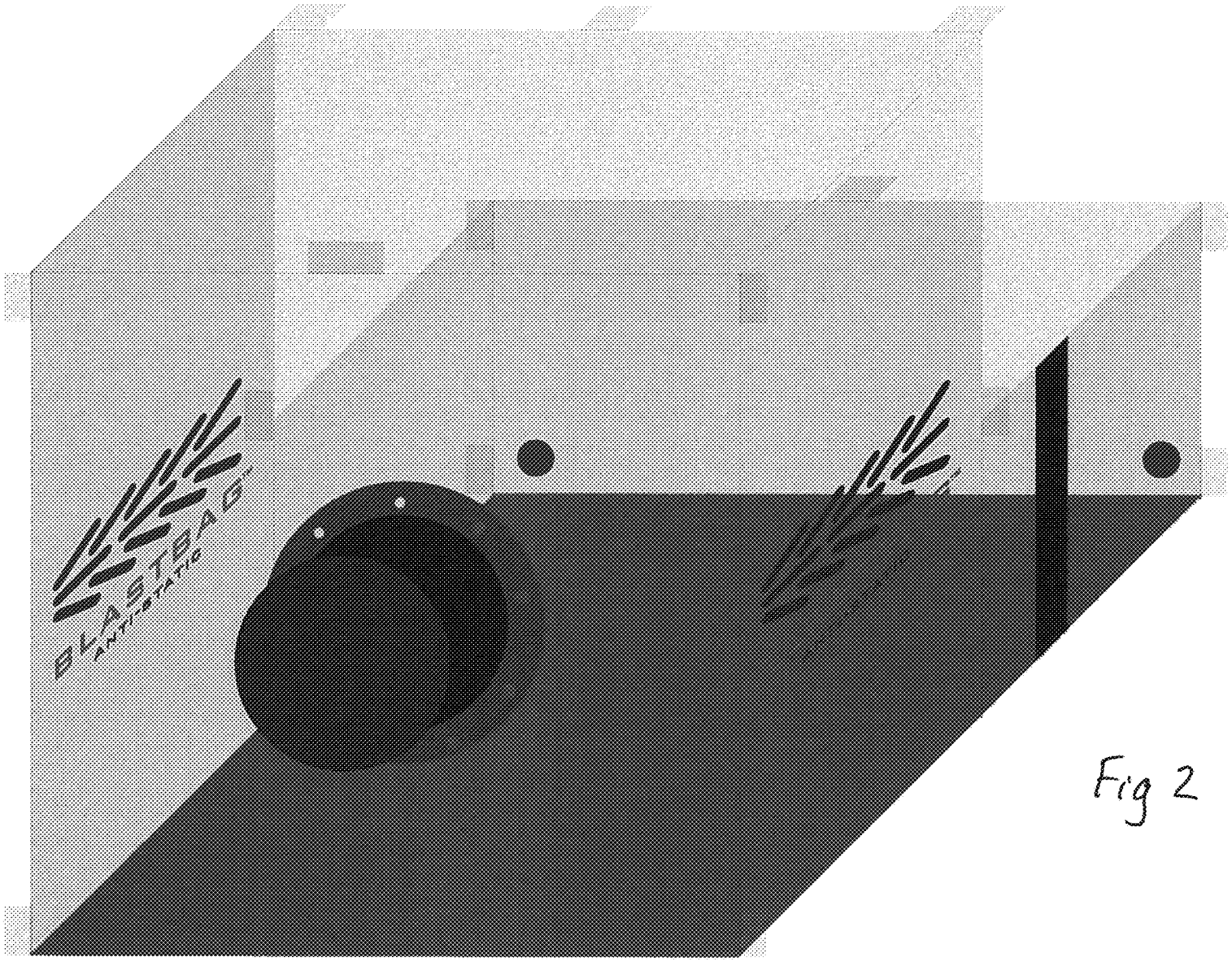
FIG. 2 is a perspective schematic view of the assembly of FIG. 1 from an opposing view.
Figure 3:
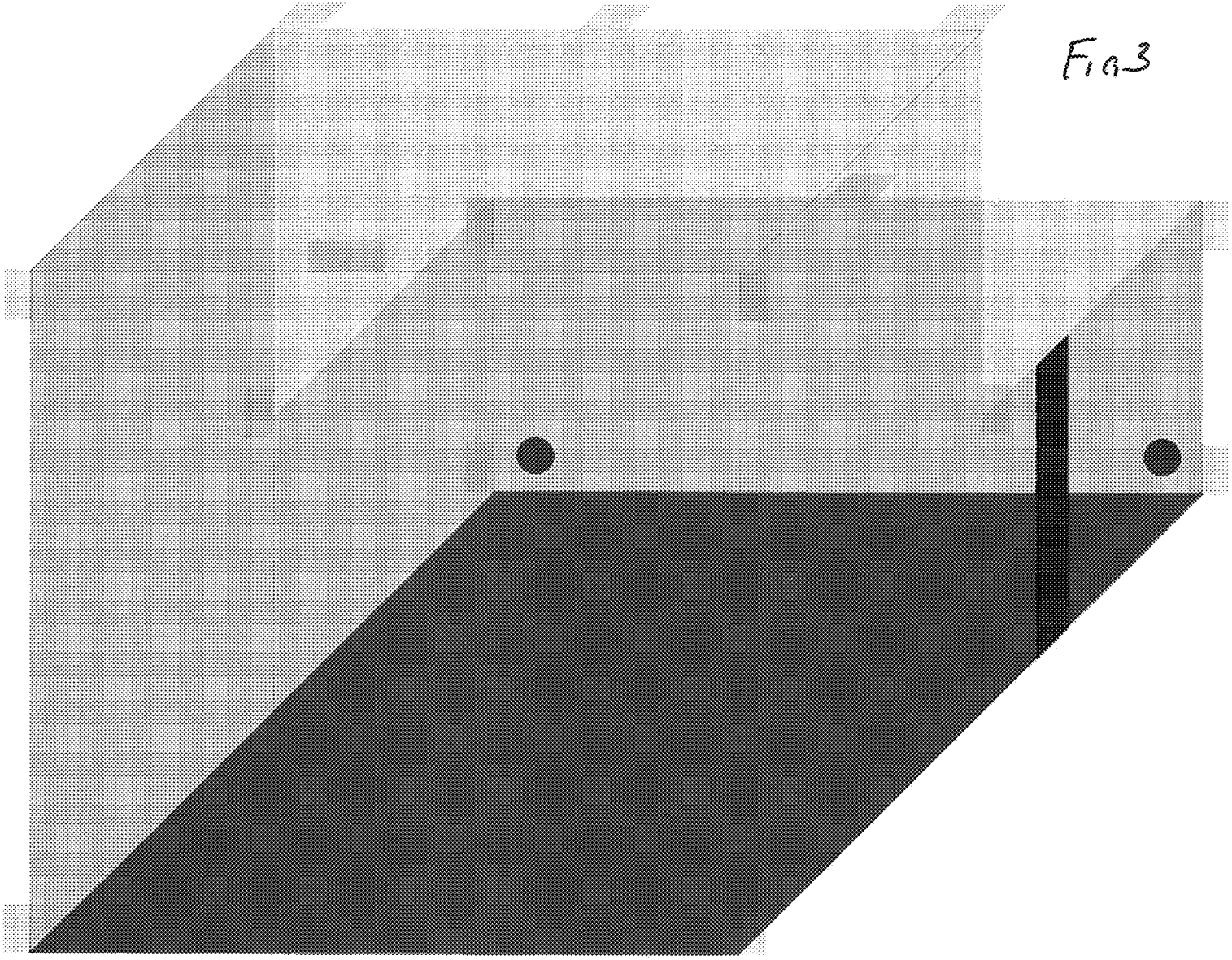
FIG. 3 is a perspective schematic view of the assembly from the front with the process vessel removed for clarity.
Figure 4:
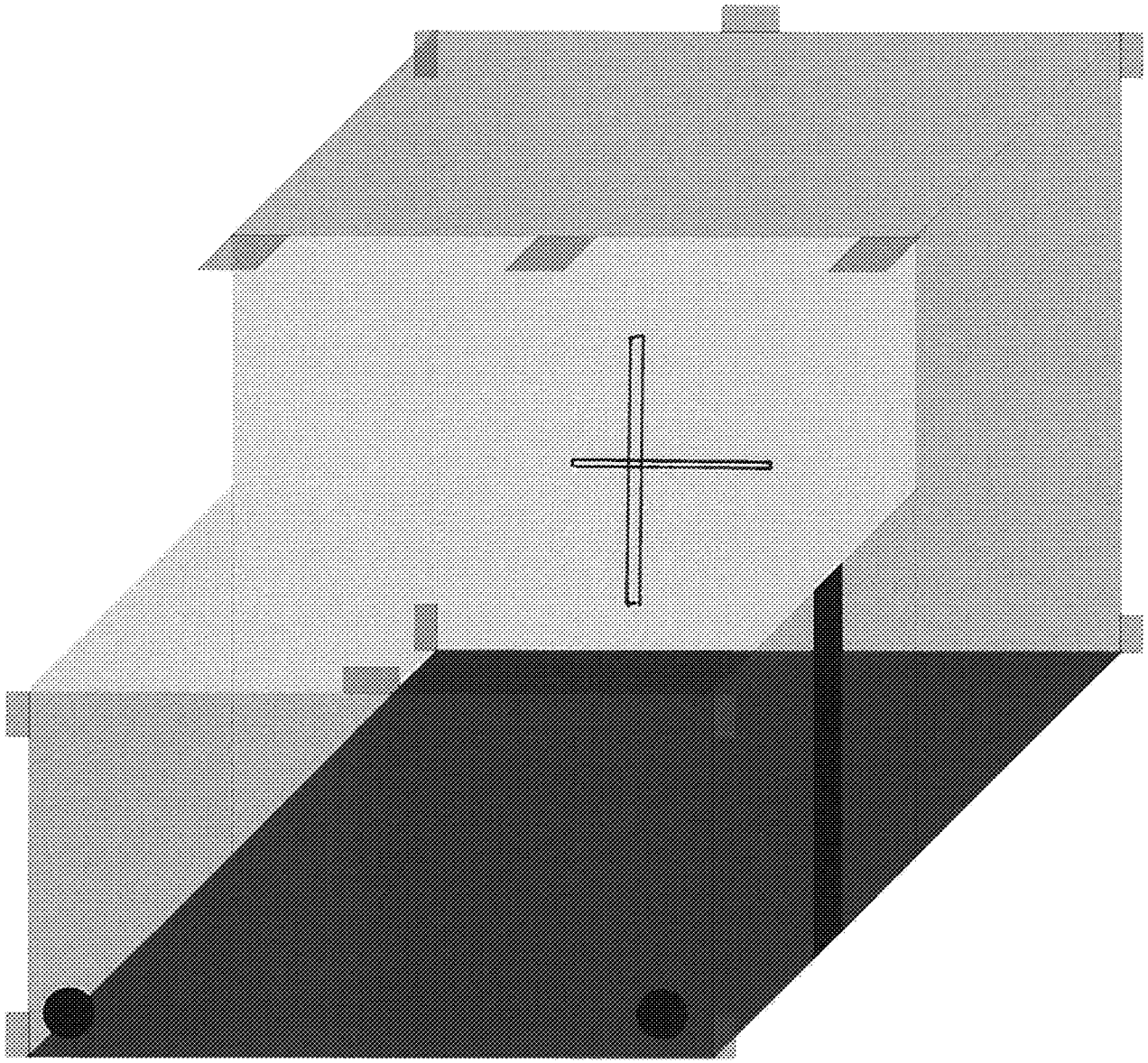
FIG. 4 is a perspective schematic view of the assembly from the rear with the process vessel removed for clarity and showing a schematic of an XY indexer-type spray system.

The containment structure includes a skeleton and a sheet assembly. In general, the containment structure has the shape of hood and an open back to enable personnel to easily see into the structure for assessing the operation of spray equipment. The skeleton preferably is formed of structural tubing or light structural shapes using conventional techniques for assembling the tubes or structural shapes together.

The process cleaning equipment preferably is an XY indexer, such as sold by Hydrochem LLC under the PowerIndexer™ or StandardIndexer Trade-Names™. Other types of automated spray indexers, such as chicken-wing types are contemplated. The containment structure is intended to be used with automated spray equipment. As used herein, the term "automated" refers to spray equipment that is moved or controlled by an actuator. Preferably the actuator is motorized or pneumatically or hydraulically actuated, and also encompasses manually moved devices such as hand-wheel controls, such as those provided by HydroChem's StandardIndexer.

As illustrated in the figures, the fluid containment structure 10 includes a skeleton structure 20 and a sheet assembly 40. Skeleton structure 20 preferably includes left and right vertical front members 22*a* and 22*b*; left and right vertical rear members 28*a* and 28*b*; left and right lower horizontal side members 24 and 26 that connect the lower ends of the front members to the lower ends of the rear members; left and right horizontal top members 30*a* and 30*b* that project rearward from the top ends of the front vertical members; and bottom and upper horizontal rear members 38*a* and 38*b* that extend between the bottom ends of the rear vertical members and the upper end of the rear vertical members, respectively; and front and aft horizontal top members 30*c* and 30*d* that extend between the front and rear ends of the horizontal top members, and front horizontal lower member 32.

The members can be any structural members, such as structural pipe held together the conventional pipe couplings, structural steels members, such as angles or channels, held together with bolts and flange plates as needed, and like structure. The skeleton structure 20 can be adjustable or have fixed dimensions.

Sheet assembly 40 includes a front sheet 42, a pair of opposing side sheets 44 and 46, a rear sheet 48, a top sheet 50, and a floor sheet 52. The edges of the sheets are joined together as described elsewhere herein, and may be held together by hook and loop fasteners or other easy to apply fasteners. Alternatively, some or all of the edges can be joined together by stitching, heat welding, or other conventional means. The vertical height of the front sheet 42, as well as front vertical support members 22*a* and 22*b*, is less than the vertical height of rear sheet 48, as well as rear vertical members 28*a* and 28*b*. Top sheet 50, as well as top side members 30*a* and 30*b*, has a fore and aft dimension that is less than the fore and aft dimension of bottom sheet 52, as well as left and right bottom members 24 and 26 to form a hood that is open in the back for enabling viewing of the containment device. Each one of the front sheet 42, side sheets 44 and 46, and rear sheet 48 forms a wall. The bottom sheet 52 forms a floor, and the top sheet 50 forms a hood with a front portion of the side sheets.

Preferably, the rear wall (formed by the rear sheet 48) and a rear portion of both side sheets 44 and 46 have a height of no more than four feet in height. The hood has a height of at least six feet and preferably six to nine feet to enable personnel to access the automated spray equipment. Accordingly, in a preferred embodiment, the side sheets 44 and 46 are L-shaped. The floor preferably is at least five feet by five feet in plan view, more preferably between five feet and nine feet. The floor sheet, sidewall, rear sheet, and/or front sheet is fitted with a drain port 70 to provide effluent from the spray or effluent spilling out of process vessel.

Further, at least one of the side sheets 44 and 46 and the rear sheet 48 has an opening 60 for providing personnel access into the interior of the sheet assembly 10. Opening 60 can be formed of a hook-and-loop by connection between corresponding portions of the sheet. When opened, opening 60 provides a vertical gap in the sheet for enabling a person to walk through.

The skeleton support structure 20 supports the sheets to form the walls. Preferably, the sheets have tab-loops through which the support members are inserted such that the front, side, and rear walls hang, which has the advantage of isolating the structural members from misdirected or reflected spray. The containment structure of any of the preceding claims wherein each one of the edges is joined to the corresponding edge by a hook-and-loop fastener.

To accommodate the process vessel end, front sheet 42 preferably is provided as continuous without holes. At the site, a hole or orthogonal slits can be cut into front sheet 42 at the desired location and of the desired size to mount front sheet onto the process vessel.

The material of the sheets preferably is flexible and impermeable to water, such as a flexible, reinforced, rubberized material, such as a neoprene coated reinforced fabric, that is resistant to the chemicals that may be inside the pressure vessel and any solvents or other chemicals in the spray liquid. The flexible sheets facilitate shipping.

The inventor of the present invention has identified another general problem of the prior art effluent handling devices. The inventor surmises that effluent flowing over conventional plastic effluent container material or spraying onto conventional container material can produce a build-up of static electricity, such as by the triboelectric effect.

Regarding static build up generally, if a surface of the material is electrically charged, either negatively or positively, contact with an uncharged conductive object or with an object having substantially different charge may cause an electrical discharge of the built-up static electricity. Sparks from the electrical discharge can potentially ignite flammable vapours.

The inventors are not aware of any prior art, commercial application of anti-static agents used in hydroblast cleaning, but in general an antistatic agent is sometimes used to treatment of materials or their surfaces in order to reduce or eliminate buildup of static electricity from the triboelectric effect. Some agents work by making the surface or the material less conductive. Some antistatic agents are themselves conductive. Internal antistatic agents are designed to be mixed directly into the material, external antistatic agents are applied to the surface.

Many common antistatic agents are based on long-chain aliphatic amines (optionally ethoxylated) and amides, quaternary ammonium salts (e.g., behentrimonium chloride or cocamidopropyl betaine), esters of phosphoric acid, polyethylene glycol esters, polyols, or indium tin oxide or antimony tin oxide. It is also possible to use conductive polymers, like PEDOT:PSS and conducting polymer nanofibers, particularly polyaniline nanofibers.

In some cases, the sheets are made of a conventional anti-static material, as will be understood by persons familiar with anti-static polymers, to inhibit a build-up to static charged from the blasting fluid onto the fluid containment structure 10. In an alternative embodiment, the sheets may include an anti-static coating, thereby allowing the material of the fluid containment structure 10 to be made of any resilient material and still have anti-static properties. Additionally, the sheet assembly may include a grounded conductive wire.

While the disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. A containment structure for use in automated hydroblasting spray cleaning of a process vessel, the containment structure comprising:

a skeleton structure; and a chemically resistant sheet assembly, including a front sheet, a pair of opposing side sheets, a rear sheet, a top sheet, and a floor sheet, each one of the front sheet and side sheets supported by the skeleton structure; wherein the front sheet is adapted for forming a first opening therein for mating to an open end of a process vessel end;

a front edge of a first one of the side sheets is joined to a first side edge of the front sheet, a front edge of a second one of the side sheets is joined to a second side edge of the front sheet;

the top edge of the first side sheet is joined to a first side edge of the top sheet, the top edge of the second side sheet is joined to a second side edge of the top sheet;

a front edge of the top sheet is joined to a top edge of the front sheet;

a first edge of the rear sheet is joined to a rear edge of the first one of the side sheets, a second edge of the rear sheet is joined to a rear edge of the second one of the side sheets;

a front edge of the floor sheet is joined to a bottom edge of the front sheet, a first side edge of the floor sheet is joined to a bottom edge of the first one of the side sheets, a second side edge of the floor sheet is joined to the bottom edge of the second one of the side sheets, a rear edge of the floor sheet is joined to the bottom edge of the rear sheet;

wherein the side sheets have a rear height that is less than a front height of the side sheets and the rear sheet has a height that is less than a height of the front sheet such that the sheet assembly is adapted for forming a hood over an end of the process vessel and the sheet assembly defines a second opening at its rear end, the second opening being surrounded by a rear edge of the top sheet, first and second inner edges of the side sheets, and a top edge of the rear sheet, and wherein the containment structure is adapted for housing automated spray cleaning equipment.

2. The containment structure of claim 1, wherein at least the front sheet and the side sheets include loops through which structural members of the skeleton structure are inserted, such that the front sheet and side sheets are hung from the skeleton structure and the skeleton structure is not exposed to a spray liquid during automated hydroblasting spray cleaning.

3. The containment structure of claim 1, wherein the top sheet includes loops through which structural members of the skeleton structure are inserted, such that the top sheet is hung from the skeleton structure.

4. The containment structure of claim 1, wherein the spray cleaning is performed by an XY indexer.

5. The containment structure of claim 1, wherein at least one of the sheets rests on an outboard side of the skeleton structure.

6. The containment structure of claim 1, wherein each one of the side sheets is L-shaped.

7. The containment structure of claim 1, wherein each one of the edges is joined to the corresponding edge by a hook-and-loop fastener.

8. The containment structure of claim 1, wherein at least one pair of the edges is permanently joined.

9. The containment structure of claim 8, wherein the at least one pair of edges is permanently joined by at least one of stitching and heat welding.

10. The containment structure of claim 1, wherein each one of the sheets is formed of an anti-static material.

11. The containment structure of claim 1, wherein the sheet assembly is disposable and when used with a hazardous substance is intended for a single use.

12. The containment structure of claim 1, wherein the skeleton structure is modular such that the containment structure is capable of being disassembled and later reassembled at another site.

13. The containment structure of claim 1, further comprising a drain.

14. The containment structure of claim 1, wherein the floor sheet is approximately 6 feet by 6 feet.

15. The containment structure of claim 1, wherein a rear portion of at least one of the side sheets is less than four feet tall.

16. The containment structure of claim 1, wherein the rear sheet is less than four feet tall.

17. The containment structure of claim 1, wherein the opening of the front sheet is adapted to be sized and located on the front sheet to correspond to a size and a location of the open end of the process vessel end.

18. The containment structure of claim 1, further comprising a personnel access opening in one of the side sheets.

19. A containment structure for use in automated hydroblasting spray cleaning of a process vessel, the containment structure comprising:

a chemically resistant sheet assembly, including a front sheet, a pair of opposing side sheets, a rear sheet, a top sheet, and a floor sheet, each one of the front sheet and side sheets adapted for being supported by a skeleton structure; wherein the front sheet has an opening or is adapted for forming an opening therein for mating to an open end of a process vessel end;

a front edge of a first one of the side sheets is adapted to be joined to a first side edge of the front sheet, a front edge of a second one of the side sheets is adapted to be joined to a second side edge of the front sheet;

the top edge of the first side sheet is adapted to be joined to a first side edge of the top sheet, the top edge of the second side sheet is adapted to be joined to a second side edge of the top sheet;

a front edge of the top sheet is adapted to be joined to a top edge of the front sheet;

a first edge of the rear sheet is adapted to be joined to a rear edge of the first one of the side sheets, a second edge of the rear sheet is adapted to be joined to a rear edge of the second one of the side sheets;

a front edge of the floor sheet is adapted to be joined to a bottom edge of the front sheet, a first side edge of the floor sheet is adapted to be joined to a bottom edge of the first one of the side sheets, a second side edge of the floor sheet is adapted to be joined to the bottom edge of the second one of the side sheets, a rear edge of the floor sheet is adapted to be joined to the bottom edge of the rear sheet;

wherein the chemically resistant sheet assembly is configured to withstand spray liquid at high pressures used during automated hydroblasting spray cleaning and to contain the high-pressure spray liquid within, wherein the side sheets have a rear height that is less than a front height of the side sheets and the rear sheet has a height that is less than a height of the front sheet such that the sheet assembly is adapted for forming a hood over the process vessel end and the sheet assembly is partially open at its rear end, and wherein the containment structure is adapted for housing automated spray cleaning equipment.

20. The containment structure of claim 1, wherein the chemically resistant sheet assembly is configured to withstand spray liquid at high pressures used during automated hydroblasting spray cleaning and to contain the high-pressure spray liquid within.

21. The containment structure of claim 1, wherein the first inner edges of the side sheets extend vertically downward from their respective top edges, wherein the first inner edges and the rear edge of the top sheet define a vertical opening, the vertical opening being substantially parallel to the front sheet.

* * * * *